US006598672B2

(12) United States Patent
Bell et al.

(10) Patent No.: US 6,598,672 B2
(45) Date of Patent: Jul. 29, 2003

(54) ANTI-EXTRUSION DEVICE FOR DOWNHOLE APPLICATIONS

(75) Inventors: Merle L. Bell, Willis, TX (US); Daniel P. Bagley, The Woodlands, TX (US); Scott C. Schuette, The Woodlands, TX (US)

(73) Assignee: Greene, Tweed of Delaware, Inc., Wilmington, DE (US)

( * ) Notice: Subject to any disclaimer, the term of this patent is extended or adjusted under 35 U.S.C. 154(b) by 0 days.

(21) Appl. No.: 09/974,122

(22) Filed: Oct. 9, 2001

(65) Prior Publication Data

US 2002/0043368 A1 Apr. 18, 2002

Related U.S. Application Data

(60) Provisional application No. 60/239,762, filed on Oct. 12, 2000.

(51) Int. Cl.[7] ..... E21B 33/12

(52) U.S. Cl. ..... 166/118; 166/134

(58) Field of Search ..... 166/387, 118, 166/134, 203, 123, 181, 182

(56) References Cited

U.S. PATENT DOCUMENTS

| | | | | |
|---|---|---|---|---|
| 2,780,294 A | | 2/1957 | Loomis | |
| 3,036,639 A | | 5/1962 | Baker | |
| 3,038,542 A | | 6/1962 | Loomis | |
| 4,852,394 A | * | 8/1989 | Goans | 73/49.8 |
| 5,103,904 A | | 4/1992 | Luke et al. | |
| 5,306,021 A | | 4/1994 | Morvant | |
| 5,443,269 A | | 8/1995 | Loritz | |
| 5,524,905 A | | 6/1996 | Thoman et al. | |
| 5,603,511 A | | 2/1997 | Keyser, Jr. et al. | |
| 5,676,384 A | | 10/1997 | Culpepper | |
| 5,701,959 A | | 12/1997 | Hushbeck et al. | |
| 5,879,010 A | | 3/1999 | Nilkanth et al. | |
| 5,944,102 A | | 8/1999 | Kilgore et al. | |
| 6,167,963 B1 | | 1/2001 | McMahan et al. | |

FOREIGN PATENT DOCUMENTS

GB 2 337 064 A 11/1999

* cited by examiner

*Primary Examiner*—William Neuder
(74) *Attorney, Agent, or Firm*—Akin Gump Strauss Hauer & Feld, L.L.P.

(57) ABSTRACT

An anti-extrusion ring for a packer assembly comprises first and second ring portions that are divided into a plurality of discrete arcuate segments. The segments are adapted for movement between a retracted position wherein each segment is in contact with adjacent segments, and an expanded position wherein gaps are formed between the segments. At least one of the ring portions is adapted to face a resilient sealing sleeve of the packer assembly. The first ring portion is circumferentially offset from the second ring portion such that at least one of the first and second ring portions extends across the gaps during movement of the segments toward the expanded position. In this manner, extrusion of the sealing sleeve through the gaps is prevented.

20 Claims, 9 Drawing Sheets

ANTI-EXTRUSION DEVICE FOR DOWNHOLE APPLICATIONS

CROSS-REFERENCE TO RELATED APPLICATIONS

This application claims the benefit of U.S. Provisional Application No. 60/239,762 filed on Oct. 12, 2000.

BACKGROUND OF THE INVENTION

This invention relates to downhole devices for subsurface wells or bores, and more particularly to an anti-extrusion ring assembly for downhole packing devices used in elevated temperature and pressure environments.

Expandable packer assemblies are commonly used in the oil and gas industry to seal or close off the annular area between a well bore casing and a drill pipe or tubing. The packer assembly includes a sealing sleeve or packer that is cylindrically shaped and typically has a smaller outer diameter as compared to the inner diameter of the particular casing to be sealed, and is thus easily inserted and positioned within the annular area. Expandable packers may, for example, be constructed of rubber or some other elastomeric material and include a central axial bore through which various types of tools or tubing may be inserted. A mandrel may, for example, be located in the axial bore of the packer, wherein the packer and mandrel are positioned within the casing at a predetermined location and/or depth, in the case of a subterranean well. Activation of the mandrel in combination with upper and lower slip members creates axial compression setting forces which are applied to the axial ends of the packer. The axial compression setting forces cause a reduction in the axial length of the packer and a corresponding increase in the packer outer diameter. As a result, the packer seals against the inner surface of the casing to effectively seal the annular area. An anti-extrusion ring, typically in the form of a split metallic ring, is positioned between the packer and each of the upper and lower slip members. The anti-extrusion rings are intended to prevent extrusion of the packer under elevated temperature and pressure conditions that would otherwise destroy the packer and/or the seal between the packer and the inner wall of the casing.

During use, it may become necessary to remove the packer for various reasons, typically by drilling through the packer and the metallic anti-extrusion rings. Although the elastomeric packer material is relatively easy to drill through, removal of the metallic rings has proven to be more difficult.

SUMMARY OF THE INVENTION

It is therefore an object of the present invention to provide an anti-extrusion ring for a packer assembly that is relatively easy to remove, even after the packer assembly has been set in a casing or other tubing.

It is a further object of the invention to provide an anti-extrusion ring for a packer assembly that is multi-segmented.

According to the invention, an anti-extrusion ring for a packer assembly comprises first and second ring portions that are divided into a plurality of discrete arcuate segments. The segments are adapted for movement between a retracted position wherein each segment is in contact with adjacent segments, and an expanded position wherein gaps are formed between the segments. At least one of the ring portions is adapted to face a resilient sealing sleeve of the packer assembly. The first ring portion is circumferentially offset from the second ring portion such that at least one of the first and second ring portions extends across the gaps during movement of the segments toward the expanded position. In this manner, extrusion of the sealing sleeve through the gaps is prevented.

Further according to the invention, a downhole packer assembly for use in a well bore comprises an elongate mandrel adapted for positioning in the well bore; an expander adapted for sliding movement along the mandrel; a resilient sealing sleeve disposed around the mandrel for engaging the well bore; and at least one anti-extrusion ring disposed between the expander and the sealing sleeve. The at least one anti-extrusion ring comprises first and second ring portions that are divided into a plurality of discrete arcuate segments. The segments are adapted for movement between a retracted position wherein each segment is in contact with adjacent segments, and an expanded position wherein gaps are formed between the segments. At least one of the ring portions contacts the sealing sleeve. The first ring portion is circumferentially offset from the second ring portion such that at least one of the first and second ring portions extends across the gaps during movement of the segments toward the expanded position. In this manner, extrusion of the sealing sleeve through the gaps is prevented.

Other objects and advantages of the invention will become apparent upon reading the following detailed description and appended claims, and upon reference to the accompanying drawings.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

It is noted that the drawings are merely schematic representations of the invention and depict only typical embodiments thereof. The invention will now be described with additional detail through the accompanying drawings.

DETAILED DESCRIPTION OF THE INVENTION

Figure 1:
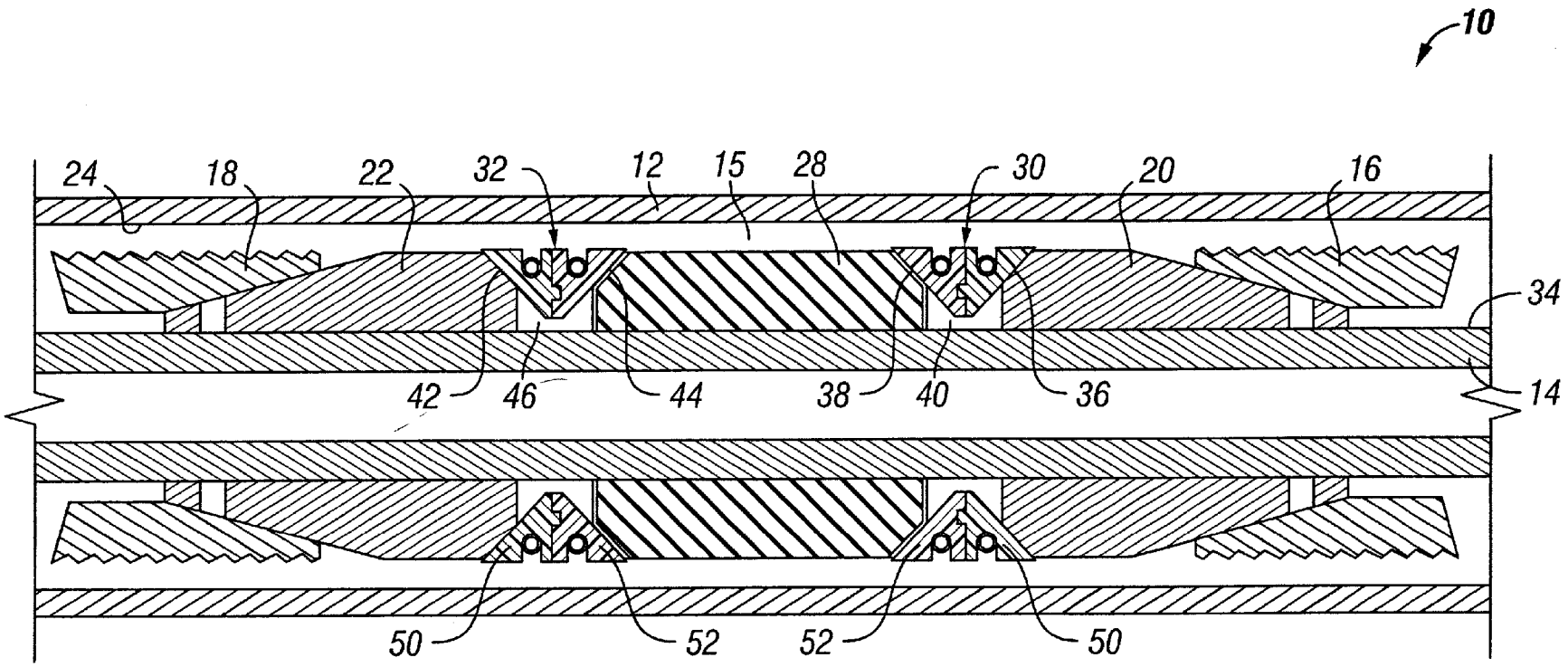
FIG. 1 is a longitudinal sectional view of a packer assembly according to the present invention disposed in a casing in a retracted position.
Figure 2:
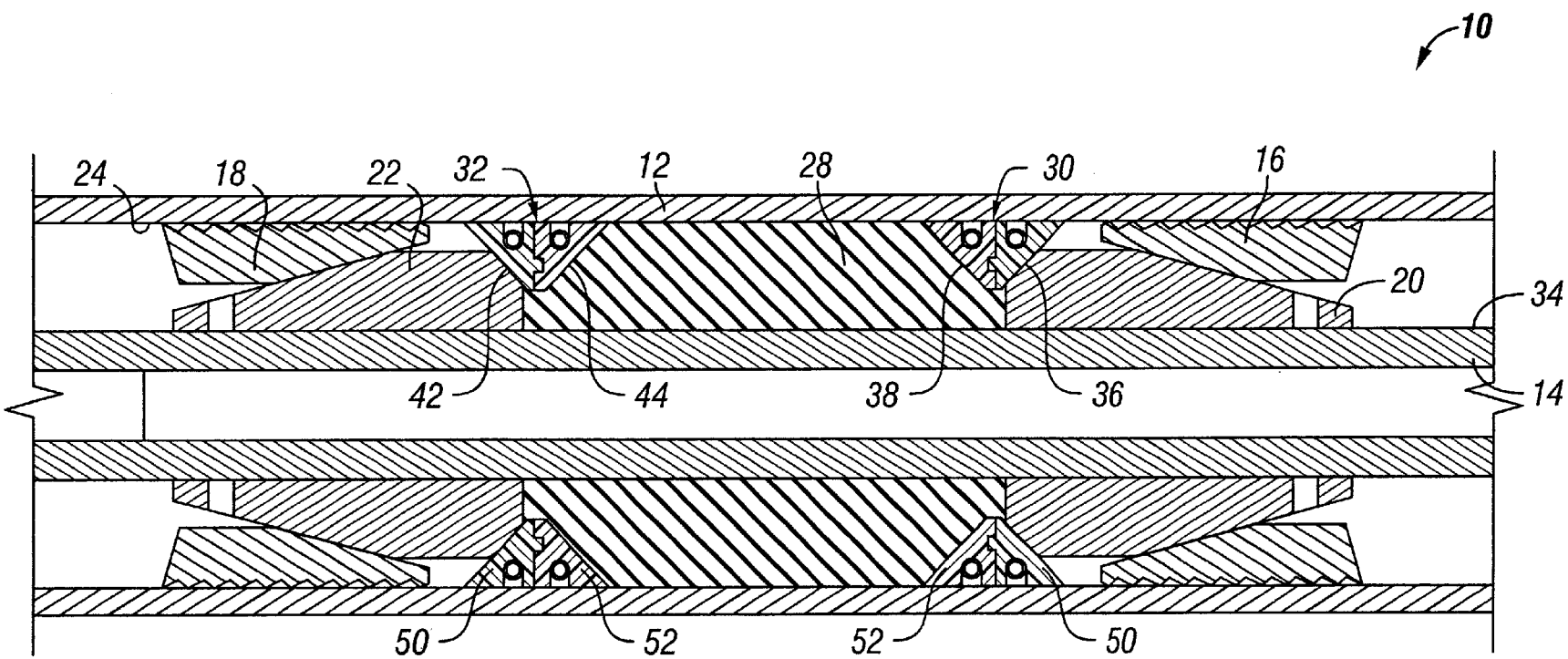
FIG. 2 is a view similar to FIG. 1 with the packer assembly in an expanded position against the casing.

Referring now to the drawings, and to FIGS. 1 and 2 in particular, a packer assembly 10 according to the present invention is illustrated. The packer assembly 10 is adapted to seal the annular space 15 between a well casing 12 or other conduit string, and a main body or mandrel 14. The packer assembly 10 can be lowered in the well casing to the desired setting point by means of a suitable running-in string (not shown), and its parts can be expanded outwardly by a suitable setting apparatus (not shown) in a well-known manner. Setting the packer assembly 10 at a desired location in the casing 12 is described in U.S. Pat. No. 3,036,639, the disclosure of which is hereby incorporated by reference, and therefore will not be further described.

The packer assembly 10 includes a mandrel 14 with an upper frusto-conical expander 20 and a lower frusto-conical expander 22 initially connected to the mandrel by shear screws (not shown) or other attachment means. An upper segmented slip 16 and a lower segmented slip 18 are in turn initially connected to the upper and lower expanders, respectively, by shear screws (not shown) or other attachment means. The upper and lower expanders 20, 22 are adapted to expand the upper and lower segmented slips 16, 18, respectively, into engagement with an inner surface 24 of the casing 12.

A sealing sleeve 28 is positioned between the expanders 20, 22 and is constructed of a pliant, elastic material, such as synthetic or natural rubber. As shown in FIG. 1, the sealing sleeve 28 is disposed initially in a retracted position free from contact with the inner surface 24 of the casing 12. An anti-extrusion ring 30 is positioned between the upper expander 20 and an upper end of the sealing sleeve 28 and an anti-extrusion ring 32 is positioned between the lower expander 22 and a lower end of the sealing sleeve 28. Relative movement of the expanders 20, 22 toward one another will shorten the axial length of the sealing sleeve 28 and expand it radially outwardly into sealing engagement with the inner surface 24 of the casing 12, as well as radially inwardly into sealing engagement with the outer surface 34 of the mandrel 14, as shown in FIG. 2. The rings 30 and 32 prevent the elastomeric material of the sealing sleeve 28 from flowing and breaking its seal between the inner surface 24 of the casing 12 and the outer surface 34 of the mandrel 14, which may otherwise occur under high temperature and pressure conditions.

The lower end of the upper expander 20 has a tapered surface 36 that extends in an upward and outward direction. Likewise, the upper end of the sealing sleeve 28 has a tapered surface 38 that extends in a downward and outward direction to thereby form a generally triangular-shaped annular groove 40 into which the ring 30 is received, which is also generally triangular-shaped in cross section. The upper end of the lower expander 22 has a tapered surface 42 that extends in a downward and outward direction. Likewise, the lower end of the sealing sleeve 28 has a tapered surface 44 that extends in an upward and outward direction to thereby form a generally triangular-shaped annular groove 46 into which the ring 32 is received. The rings 30 and 32 are identical in construction, with the ring 32 being installed in a mirror-reverse orientation with respect to the ring 30.

Figure 3:
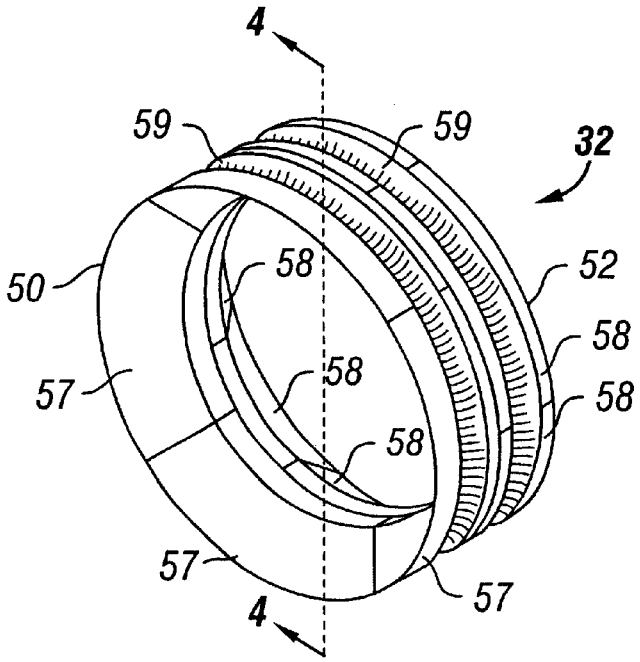
FIG. 3 is an isometric view of an anti-extrusion ring according to a first embodiment of the invention that forms part of the packer assembly.
Figure 4:
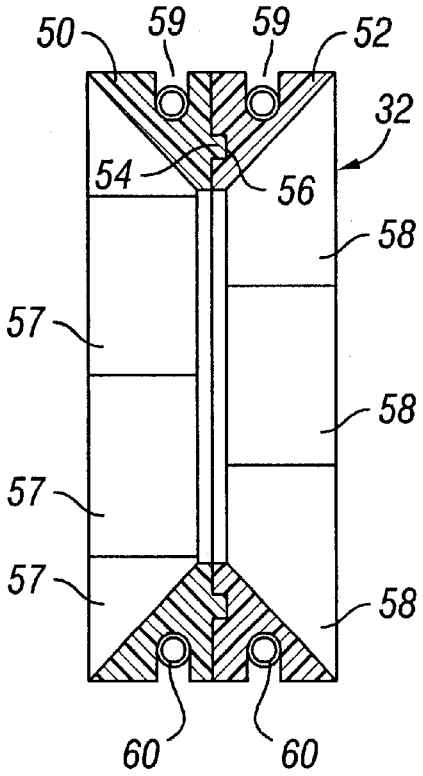
FIG. 4 is a sectional view of the anti-extrusion ring taken along line 4—4 of FIG. 3.

With reference now to FIGS. 3 and 4, the anti-extrusion ring 32 will now be described, it being understood that the anti-extrusion ring 30 is constructed in an identical manner. The ring 32 includes an outer ring portion 50 and an inner ring portion 52. The outer ring portion 50 has an annular tongue 54 that is slidably received within an annular groove 56 formed in the inner ring portion 52. Each ring portion 50 and 52 is divided into a plurality of arcuate segments 57 and 58, respectively. Each segment 57, 58 includes an arcuate groove 59 that, together with the other respective segments, form a continuous groove that receives an annular biasing member 60 to hold the segments 57, 58 together. The biasing member 60 is preferably in the form of a continuous tension spring. Alternatively, the biasing member 60 may be in the form of an elastomeric O-ring or other annular biasing member. The outer and inner ring portions 50, 52 are preferably constructed of a thermoplastic material, such as polyether ether ketone (PEEK), but may be formed of other materials such as polyamide, fiber-reinforced composite material, metal, or other suitable material having high temperature resistance and high sheer strength in order to maintain its shape without significant creeping under high temperature (preferably above 350° F.) and high pressure (preferably above 10,000 psi). In a preferred embodiment, the material can be easily drilled out or otherwise destroyed when it is necessary to remove the packer assembly 10.

Figure 5:
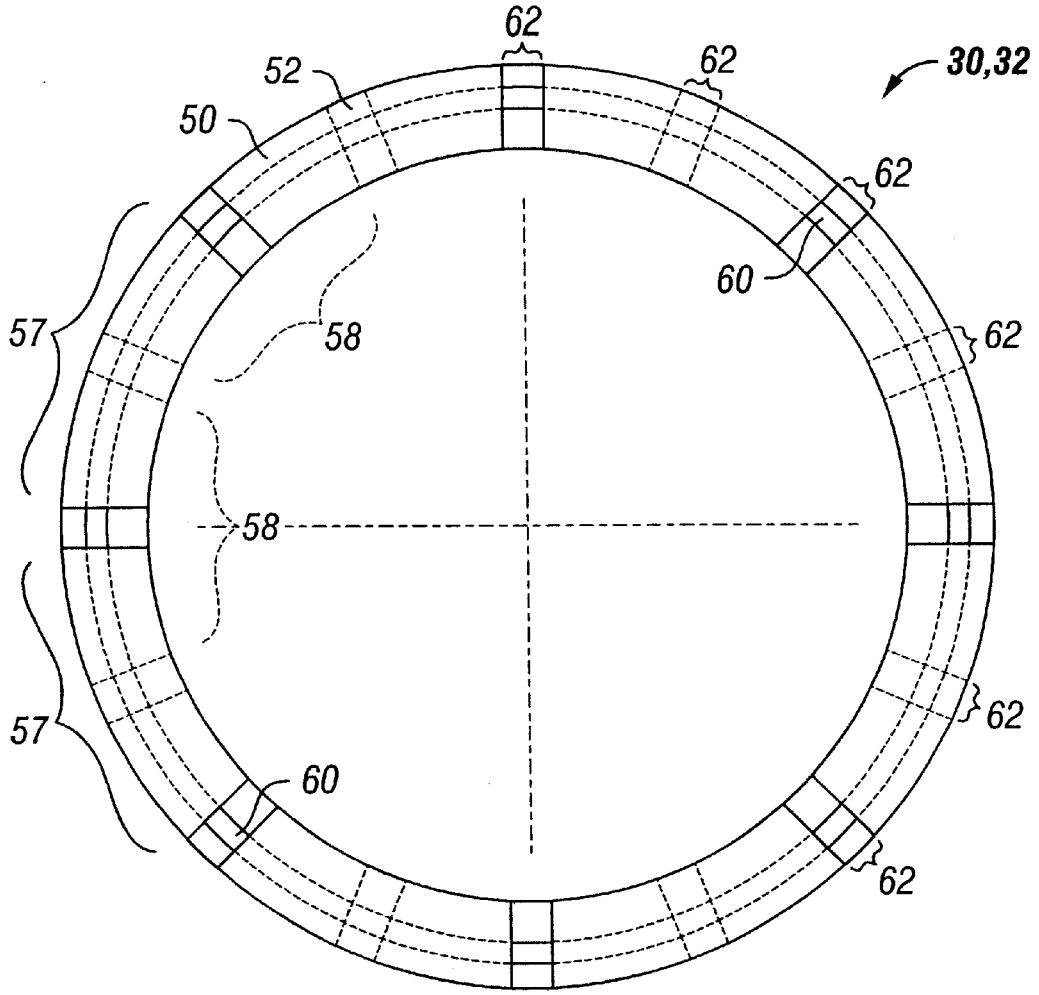
FIG. 5 is a side elevational view of the anti-extrusion ring first embodiment in an expanded position.

As shown in FIGS. 3–5, the segments 57 of the outer ring portion 50 are offset from the segments 58 of the inner ring portion 52. Due to the biasing members 60, the segments 57, 58 normally remain in a retracted position with the ends of each segment 57, 58 contacting a respective end of adjacent segments 57, 58. However, the segments 57, 58 of the ring portions 50, 52 are expandable radially outwardly by relative movement between the expanders 20, 22 and the sealing sleeve 28 (FIGS. 1 and 2) to axially shorten and radially expand the sealing sleeve 28 preferably until the segments 57, 58 are in contact with the inner surface 24 of the casing 12. During expansion, adjacent segments 57 in the ring portion 50 and adjacent segments 58 in the ring portion 52 separate to form gaps 62 (FIG. 5) while the annular tongues 54 slide in the annular grooves 56 to maintain the segments 57 of the outer ring portion 50 offset from the segments 58 of the inner ring portion 52. In this manner, the gaps 62 of the outer ring portion 50 are maintained in the offset condition with the gaps 62 of the inner ring portion 52 during movement of the anti-extrusion ring between retracted and expanded positions. The offset nature of the gaps 62 effectively prevents extrusion of the sealing sleeve 28 through the rings 30, 32 which might otherwise occur if the gaps in each ring portion 50, 52 were aligned.

Figure 8:
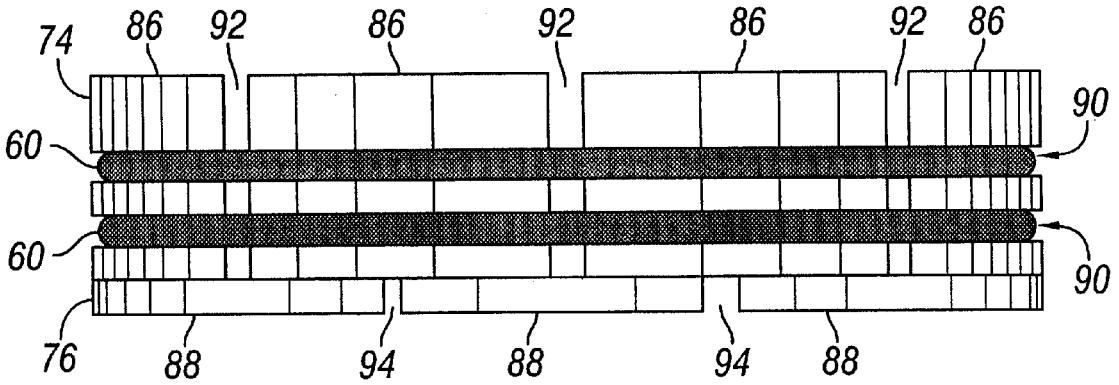
FIG. 8 is a top plan view of the anti-extrusion ring of FIG. 6.
Figure 6:
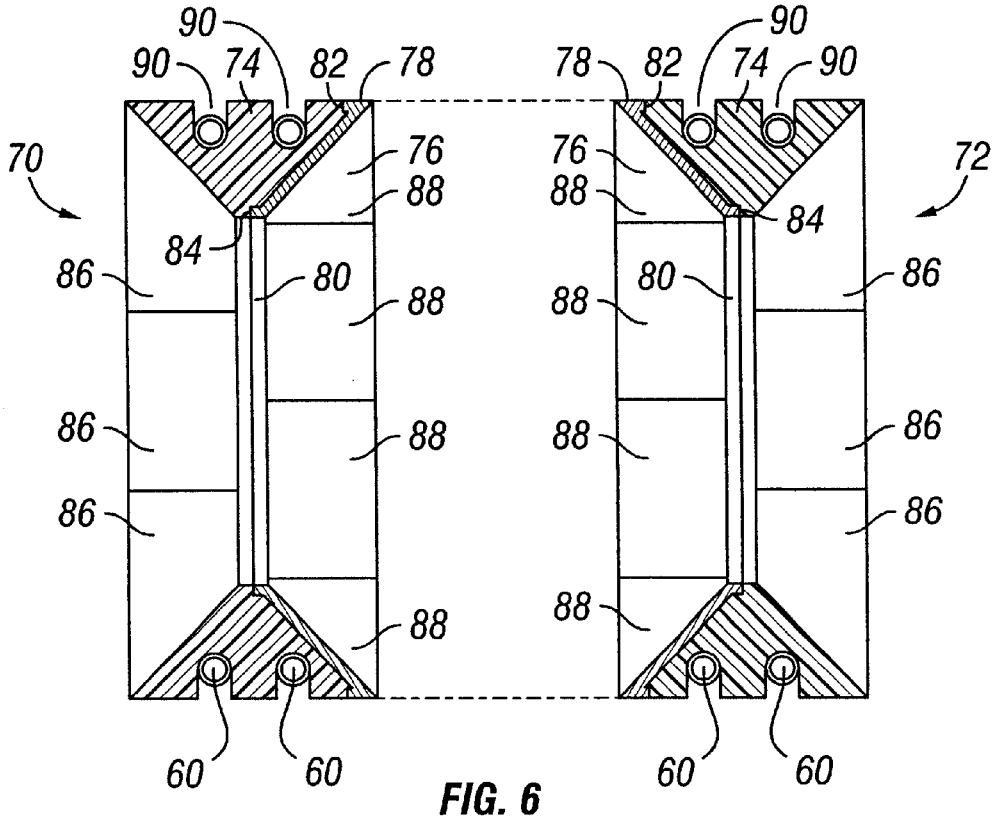
FIG. 6 is a sectional view of a pair of anti-extrusion rings according to a second embodiment of the invention.
Figure 7:
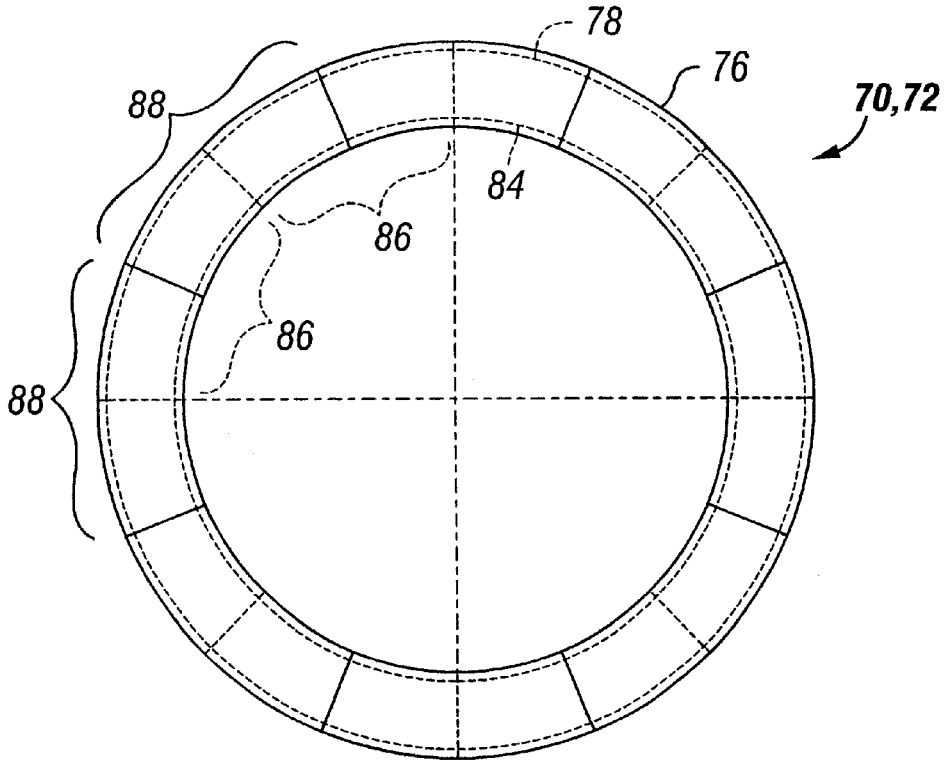
FIG. 7 is a side elevational view of an anti-extrusion ring according to the second embodiment.

With particular reference now to FIGS. 6–8, anti-extrusion rings 70 and 72 according to a second embodiment of the invention are illustrated, wherein like parts in the previous embodiment are represented by like numerals. The anti-extrusion rings 70 and 72 are identical in construction, with the ring 72 being installed in a mirror-reverse orientation with respect to the ring 70. Accordingly, the anti-extrusion ring 72 will be described, it being understood that the same description applies to the anti-extrusion ring 70. The ring 72 includes a relatively thick outer ring portion 74 and a relatively thin inner ring portion 76. The inner ring portion 76 includes an upper annular flange 78 and a lower annular flange 80 that are slidably received within an upper annular groove 82 and a lower annular groove 84, respectively, formed in the outer ring portion 74. The outer ring portion 74 is divided into a plurality of arcuate-shaped outer segments 86 while the inner ring portion 76 is divided into a plurality of arcuate-shaped inner segments 88 that are circumferentially offset from the outer segments 86. A pair of arcuate grooves 90 are formed in each outer segment 86, and together with the arcuate grooves 90 of the inner segments 86, form a pair of continuous grooves 90 that receive an annular biasing member 60 to hold the inner and outer segments 86, 88 together. Although two biasing members 60 are shown, it will be understood that more or less biasing members may be used. As in the previous embodiment, the outer and inner ring portions 74, 76 are preferably constructed of a metal or plastic material, such as PEEK, that can withstand high temperature and high pressure conditions associated with downhole environments, and yet can be easily drilled out or otherwise destroyed when it is necessary to remove the packer assembly 10.

During expansion of the ring 72, the inner segments 86 separate to form a plurality of gaps 92 (FIG. 8) and the outer segments 88 separate to form a plurality of offset gaps 94 while the annular flanges 78, 80 slide in their respective annular grooves 82, 84 to maintain the inner segments 86 of the outer ring portion 74 offset from the outer segments 88 of the inner ring portion 76. In this manner, the gaps 92 of the outer ring portion 74 are maintained in an offset condition from the gaps 94 of the inner ring portion 76 during movement of the anti-extrusion rings 70, 72 between retracted and expanded positions. The offset nature of the gaps 92, 94 effectively prevents extrusion of the sealing sleeve 28 through the ring portions 74 and 76 which might otherwise occur if the gaps in each ring portion 74, 76 were aligned. In addition, the relatively thin inner ring portion 76 decreases the amount of sealing sleeve material that is extruded within the gaps 92 when compared to the relatively thick gaps 62 of the previous embodiment. Thus, the sealing sleeve 28 will deform less in this embodiment than in the previous embodiment.

Figure 9:
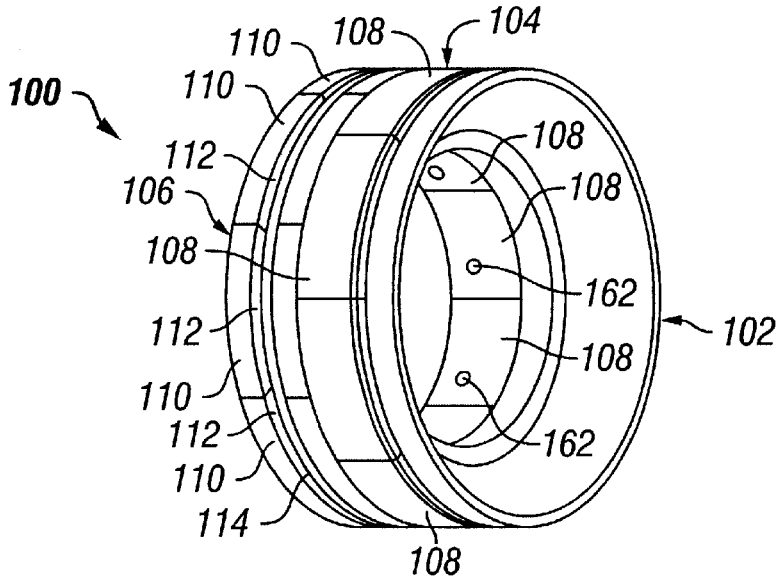
FIG. 9 is an isometric view of an anti-extrusion ring according to a third embodiment of the invention.
Figure 10:
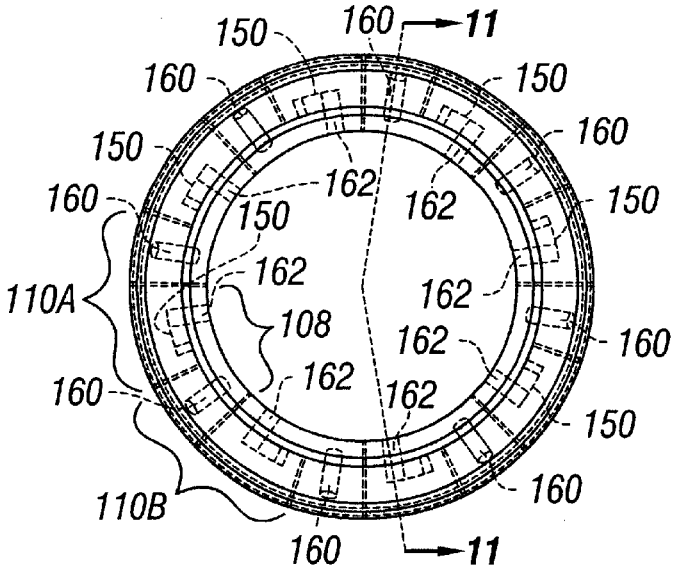
FIG. 10 is a side elevational view of an anti-extrusion ring according to the third embodiment.
Figure 11:
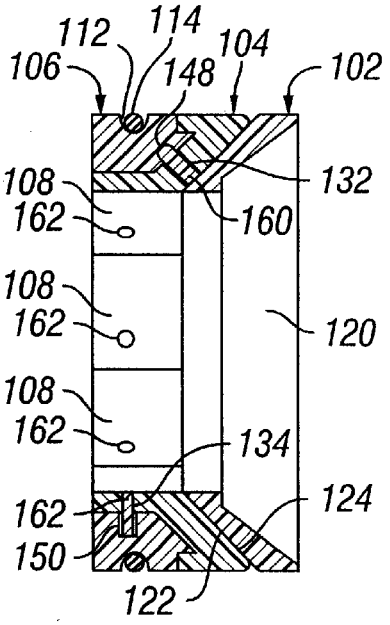
FIG. 11 is a sectional view of the anti-extrusion ring third embodiment taken along line 11—11 of FIG. 10.

Referring now to FIGS. 9–11, an anti-extrusion ring 100 according to a third embodiment of the invention is illustrated. Although only a single anti-extrusion ring 100 is shown, a further anti-extrusion ring identical in construction to the ring 100 is preferably provided in mirror-reverse orientation so that the rings are positioned between the sealing sleeve 28 (FIG. 1) and the upper and lower expanders 20 and 22, respectively, as previously described with respect to the first and second anti-extrusion ring embodiments. The anti-extrusion ring 100 includes an outer ring portion 102, an intermediate ring portion 104, and an inner ring portion 106 connected to the intermediate ring portion 102 for limited relative movement. The inner ring portion 106 is preferably in contact with the seal 28 (FIG. 1) while the outer ring portion 102 is preferably in contact with one of the upper and lower expanders 20, 22. As in the previous embodiments, each ring portion 104 and 106 is divided into a plurality of offset arcuate segments 108 and 110, respectively. Each segment 110 includes an arcuate groove 112 that, together with the other respective segments, form a continuous groove that receives an annular biasing member 114 to hold the segments 110 together. The biasing member 114 is preferably in the form of an elastomeric O-ring. Alternatively, the biasing member 114 can be in the form of a continuous tension spring or other annular biasing member.

As shown most clearly in FIG. 11, the outer ring portion 102 is preferably of a hollow frusto-conical shape and includes a tapered outer surface 120 and a tapered inner surface 122. The tapered outer surface 120 is in contact with the tapered surface 36 of the upper expander 20 or the tapered surface 42 of the lower expander 22, while the tapered inner surface 122 is in contact with a tapered outer surface 124 of the intermediate ring portion 104.

Figure 12:
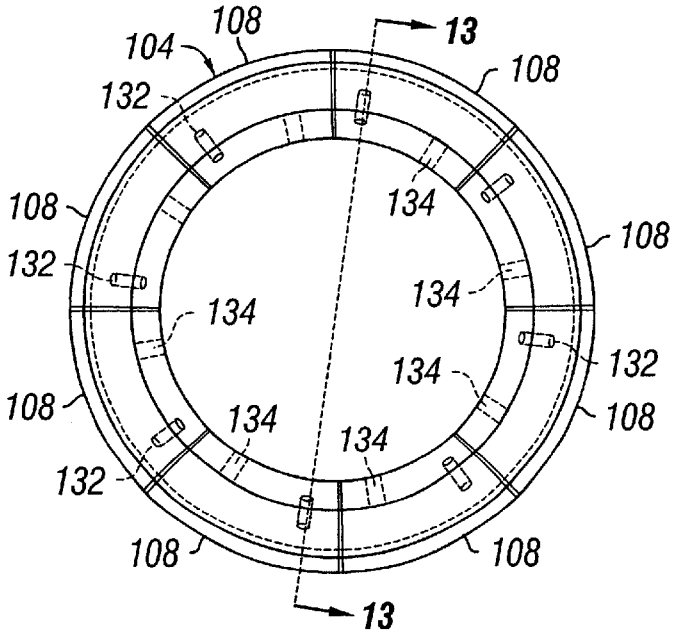
FIG. 12 is a side elevational view of an intermediate ring portion that forms part of the anti-extrusion ring third embodiment.
Figure 13:
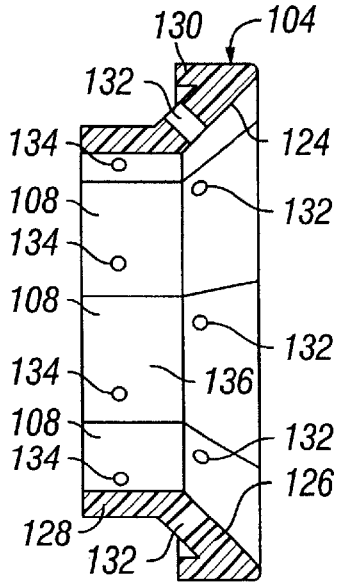
FIG. 13 is a sectional view of the intermediate ring portion taken along line 13—13 of FIG. 12.

With additional reference to FIGS. 12 and 13, the segments 108 of the intermediate ring portion 104 together form a first wall section 126 that is preferably of a generally hollow frusto-conical shape and a second wall section 128 that extends from the first wall section and is preferably of a generally hollow cylindrical shape. An annular tongue 130 extends from the first wall section 126. Each segment 108 includes a first aperture 132 that is formed in the first wall section 126 and a second aperture 134 that is formed in the second wall section 128. Preferably, the first aperture extends normal to the tapered outer surface 124, while the second aperture extends normal to a surface 136 of the second wall section 128.

Figure 14:
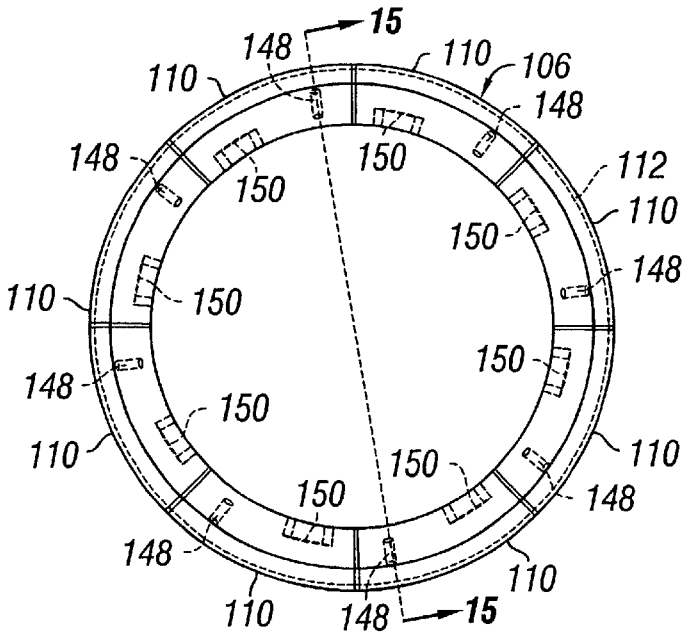
FIG. 14 is a side elevational view of an inner ring portion that forms part of the anti-extrusion ring third embodiment.
Figure 15:
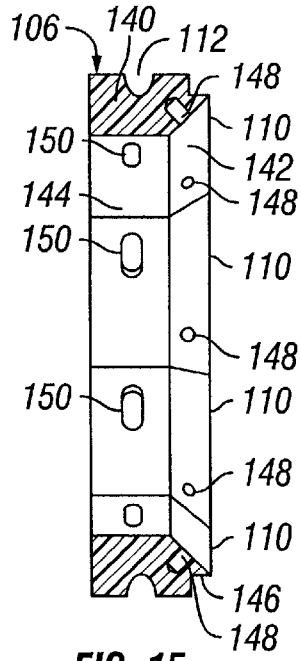
FIG. 15 is a sectional view of the inner ring portion taken along line 15—15 of FIG. 14.

As shown in FIGS. 14 and 15, the segments 110 of the inner ring portion 106 together form an annular wall 140 with a tapered outer surface 142 and an annular surface 144 that abut the first wall section 126 and second wall section 128, respectively, of the intermediate ring portion 104. An annular depression 146 is formed in the annular wall 140 and is sized for receiving the tongue 130 of the intermediate ring portion 104. Each segment 110 includes an aperture 148 that is formed in the tapered outer surface 142 and an elongate slot 150 that is formed in the annular surface 144. Preferably, the aperture 148 extends normal to the tapered outer surface 142, while the elongate slot 150 extends normal to the annular surface 144.

With reference again to FIGS. 10 and 11, each segment 108 of the intermediate ring portion 104 is circumferentially offset from a segment 110 of the inner ring portion 106. A connector pin 160 extends through the first aperture 132 of the intermediate ring portion 104 and into the aperture 148 of the inner ring portion 106 to connect each segment 108 with its corresponding offset segment 110. The connector pins and apertures can have mutually engaging threads for connecting the segments 108, 110 together. Alternatively, the connector pins can be press-fit into one or both of their associated apertures 132, 148. A guide pin 162 extends through the second aperture 134 of the intermediate ring portion 104 and into the elongate slot 150 of the inner ring portion 106. As shown most clearly in FIG. 11, the connector pin 160 associated with a segment 108 extends into the aperture 148 of a segment 110A of the inner ring portion 106, while the guide pin 162 associated with the same segment 108 extends into the elongate slot 150 of an adjacent segment 110B of the inner ring portion 106.

The segments 108, 110 normally remain in a retracted position with the ends of each segment 108 and 110 contacting respective ends of adjacent segments 108 and 110, due to the biasing member 114. However, the segments 108 and 110 are expandable radially outwardly by relative movement between the expanders 20, 22 (FIGS. 1 and 2), the sealing sleeve 28, and the outer ring 102 that acts as a wedge against the intermediate and inner rings 104, 106 to axially shorten and radially expand the sealing sleeve 28, preferably until the segments 108, 110 are in contact with the inner surface 24 of the casing 12. During expansion, adjacent segments 108 in the ring portion 104 and adjacent segments 110 in the ring portion 106 separate to form gaps (not shown) as in the previous embodiments, while the guide pins 162 slide in their associated elongate slots 150 to maintain the segments 108 of the intermediate ring portion 104 offset from the segments 110 of the inner ring portion 106.

During expansion, the segments 108, 110 may not move evenly due to differences in applied forces, friction, misalignment of the components, and so on. However, the ends of the elongate slots 150 in the segments 110 serve as end stops to arrest movement of the guide pins 162 during expansion of the segments 108, 110 to limit the amount of maximum separation between adjacent segments. Thus, when the segments 108 and 110 are fully expanded, the gaps between the segments 108 as well as the gaps between the segments 110 will be substantially uniform. In this manner, the compressive forces of the sealing sleeve 28 will be distributed substantially evenly over the segments.

The inner ring portion 102, intermediate ring portion 104, outer ring portion 108, and pins 160, 162 are preferably constructed of a thermoplastic material, such as PEEK, but may be formed of other materials such as polyamide, fiber-reinforced composite material, metal, or other suitable material having high temperature resistance and high sheer strength in order to maintain its shape without significant creeping under high temperature and high pressure, as previously described, yet can be easily drilled out or otherwise destroyed when it is necessary to remove the packer assembly 10.

With reference now to FIGS. 16–20, an anti-extrusion ring 200 according to a further embodiment of the invention is illustrated. Although only a single anti-extrusion ring 200 is shown, a further anti-extrusion ring identical in construction to the ring 200 is preferably provided in mirror-reverse orientation so that the rings are positioned between the sealing sleeve 28 (FIG. 1) and the upper and lower expanders 20 and 22, respectively, as previously described with respect to the previous embodiments. The anti-extrusion ring 200 is divided into a plurality of overlapping arcuate segments 201. Each segment 201 has a first ring portion 202 and a second ring portion 204 that is preferably integrally formed with the first ring portion. As in the previous embodiments, the segments 201 are preferably constructed of a plastic material, such PEEK or other materials such as polyamide, fiber-reinforced composite material, metal, or other suitable material as previously described to thereby facilitate removal of the packer assembly. The segments 201 can be formed by any well-known technique, such as machining or injection molding. As shown, the second ring portion 204 is axially and circumferentially offset from the first ring portion 202 such that the first ring portion 202 of one segment 201 overlaps the second ring portion 204 of an adjacent segment 201.

Figure 16:
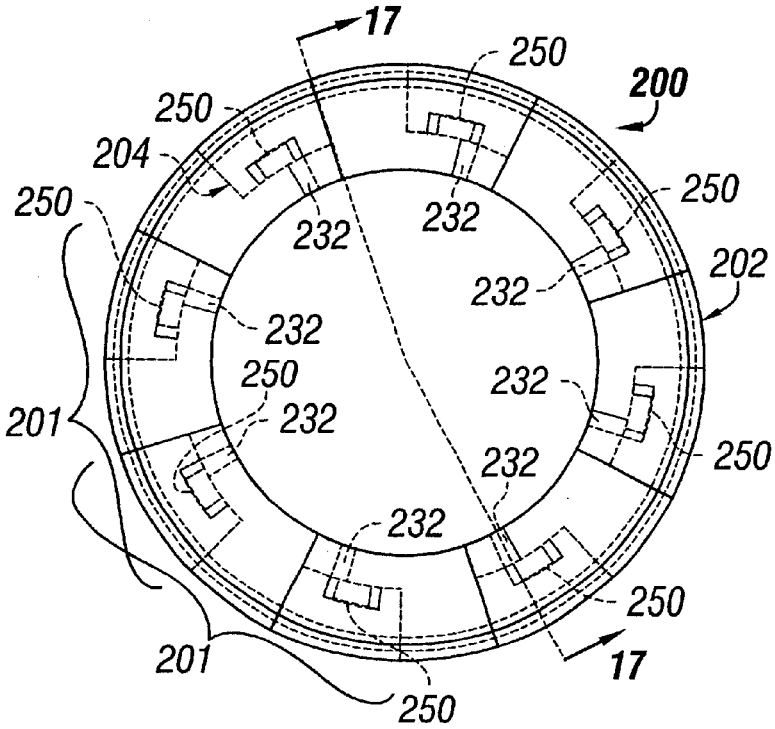
FIG. 16 is side elevational view of a portion of an anti-extrusion ring according to a fourth embodiment of the invention.

Each segment 201 includes arcuate grooves 220 and 222 that, together with the other segments, form continuous grooves that receive annular biasing members (not shown) to hold the segments 201 together in a retracted position, as shown in FIG. 16. The biasing members are preferably in the form of an elastomeric O-ring, but can alternatively be in the form of a continuous tension spring or the like. Although two arcuate grooves are shown, it will be understood that more or less may be provided.

Figure 17:
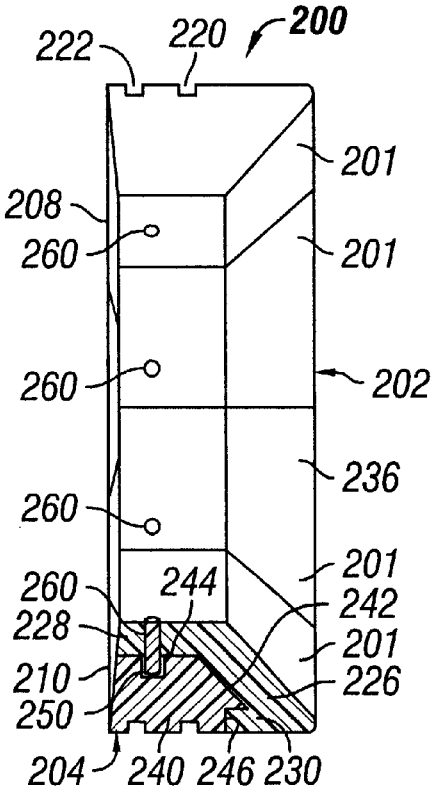
FIG. 17 is a sectional view of the anti-extrusion ring portion fourth embodiment taken along line 17—17 of FIG. 16.
Figure 19:
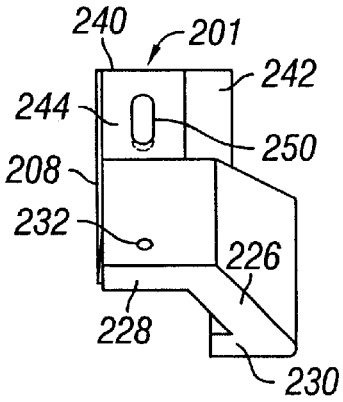
FIG. 19 is a top plan view of the anti-extrusion ring segment.
Figure 18:
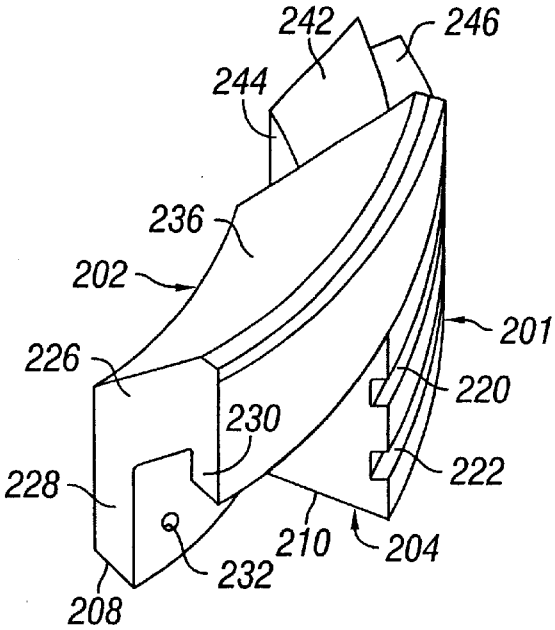
FIG. 18 is an isometric view of an anti-extrusion ring segment according to the fourth embodiment.
Figure 20:
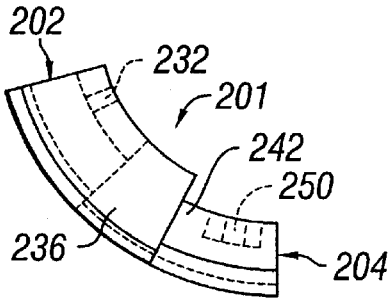
FIG. 20 is a side elevational view of the anti-extrusion ring segment.

The first ring portions 202 together form a first wall section 226 that is preferably of a generally hollow frustoconical shape and a second wall section 228 that extends from the first wall section and is preferably of a generally hollow cylindrical shape. An annular tongue 230 extends from the first wall section 226. A tapered surface 236 of the first wall section 226 is preferably in contact with either the upper or lower expander 20, 22 (FIG. 1), depending on the position of the anti-extrusion ring 200 in the packer assembly 10. Surfaces 208 and 210 are formed on the first and second ring portions, respectively, and face a direction opposite the tapered surface 236 for contacting the seal 28 (FIG. 1). The surfaces 208 and 210 are preferably flush where the ring portions on the same segment 201 intersect, as shown in FIG. 17.

The second ring portions 204 together form an annular wall 240 with a tapered outer surface 242 and an annular surface 244 that abut the first wall section 226 and second wall section 228, respectively, of a first ring portion 202 of an adjacent segment 201. An annular depression 246 is formed in the first wall section 226 and is sized for receiving the tongue 230 of the first ring portion 202 of an adjacent segment 201. Each segment 201 includes an aperture 232 that is formed in the second wall section 228 and an elongate slot 250 that is formed in the annular surface 244 of the wall 240. Preferably, the aperture 232 extends normal to the second wall section 228, while the elongate slot 250 extends normal to the annular surface 244.

A guide pin 260, preferably constructed of a plastic material, such as PEEK or the like, extends through the aperture 232 of the first ring portion 202 associated with one segment 201 and into the elongate slot 250 of the second ring portion 204 associated with an adjacent segment. It will be understood that the guide pin 260 can be formed of other materials, such as metal.

Due to the biasing member (not shown), the segments 201 normally remain in a retracted position as shown in FIG. 16 with the ends of each segment 201 contacting respective ends of adjacent segments 201. As in the previous embodiments, the segments 201 are expandable radially outwardly by relative movement between the expanders 20, 22 (FIGS. 1 and 2) and the sealing sleeve 28. Although not shown, a ring similar to the ring 102 can be provided between the segments 201 and one or both expanders 20 for wedging against the segments 201. During expansion, adjacent segments 201 separate to form gaps (not shown) as in the previous embodiments, while the guide pins 260 slide in their associated elongate annular slots 250 preferably until the segments are in contact with the inner surface 24 of the casing 12. The segments 201 may not move evenly due to differences in applied forces, friction, misalignment of the components, and so on. The ends of the elongate slots 250 provide an end stop for arresting movement of the guide pins 260 during expansion of the segments 201 to limit the amount of maximum separation between adjacent segments. Thus, when the segments 201 are fully expanded, the gaps between the segments 201 will be substantially uniform. In this manner, the compressive forces of the sealing sleeve 28 will be distributed substantially evenly over the segments. Due to the offset and overlapping nature of the first and second ring portions, the second ring portions will be located in the gaps formed between the first ring portions, while the first ring portions will be located in the gaps formed between the second ring portions, to thereby prevent extrusion of the sealing sleeve through the gaps.

In each of the above-described embodiments, the total distance between all gaps of each ring portion in its expanded condition, and especially the inner or first ring portion, is preferably no greater than the distance of the single gap of the prior art metallic anti-extrusion ring. The use of multiple segments facilitates expansion of the anti-extrusion rings and eliminates bending stresses associated with the prior art metallic rings. This feature is especially important, since a solid anti-extrusion ring with a single expansion gap constructed of a plastic material suitable for high temperature and pressure conditions in downhole environments is subject to breakage due to high internal bending stresses generated during expansion. When circumstances dictate removal of the packer assembly, the multi-segmented anti-extrusion rings according to the present invention can be relatively easily drilled out or otherwise destroyed, such as by separation of the individual segments, when compared to the prior art anti-extrusion rings.

It will be understood that the terms inner, outer, upper, lower, as well as other terms and their respective derivatives as may be used throughout the specification refer to relative, rather than absolute positions and/or orientations.

While the invention has been taught with specific reference to the above-described embodiments, those skilled in the art will recognize that changes can be made in form and detail without departing from the spirit and the scope of the invention. For example, it will be understood that the anti-extrusion rings in each of the above embodiments can be constructed with more or less segments than shown. Thus, the described embodiments are to be considered in all respects only as illustrative and not restrictive.

We claim:

1. An anti-extrusion ring for a packer assembly having a resilient sealing sleeve, the anti-extrusion ring comprising:

first and second ring portions divided into a plurality of discrete arcuate segments for movement between a retracted position wherein each segment is in contact with adjacent segments, and an expanded position wherein gaps are formed between the segments, with at least one of the ring portions being adapted to face the sealing sleeve;

an elongate slot associated with each of the segments, the elongate stop having an end stop; and a guide pin extending from each of the segments and into the elongate slot of another segment, such that movement of the segments toward the expanded position causes each guide pin to ride in its respective slot and contact the end stop to thereby arrest further movement of the segments toward the expanded position and control the size of each gap, wherein the first ring portion is circumferentially offset from the second ring portion such that at least one of the first and second ring portions extends across the gaps during movement of the segments toward the expanded position to thereby prevent extrusion of the sealing sleeve through the gaps.

2. An anti-extrusion ring according to claim 1, wherein the first and second ring portions are integrally formed together.

3. An anti-extrusion ring according to claim 2, wherein each segment comprises:

an elongate slot associated with one of the first and second ring portions, the elongate slot having an end stop; and a guide pin extending from the other of the first and second ring portions and into the elongate slot of an adjacent segment, such that movement of the segments toward the expanded position causes each guide pin to ride in its respective slot and contact the end stop to thereby arrest further movement of the segments toward the expanded position and control the size of each gap.

4. An anti-extrusion ring according to claim 1, wherein one of the first and second ring portions comprises an annular groove and the other of the first and second ring portions comprises an annular tongue that is received in the annular groove.

5. An anti-extrusion ring according to claim 1, and further comprising at least one annular biasing member extending around the segments for holding the segments together.

6. An anti-extrusion ring according to claim 1, wherein the first and second ring portions are constructed of a plastic material.

7. An anti-extrusion ring according to claim 6, wherein the plastic material comprises polyether ether ketone.

8. An anti-extrusion ring for a packer assembly having a resilient sealing sleeve, the anti-extrusion ring comprising:

first and second ring portions divided into a plurality of discrete arcuate segments for movement between a retracted position wherein each segment is in contact with adjacent segments, and an expanded position wherein gaps are formed between the segments, with at least one of the ring portions being adapted to face the sealing sleeve, the plurality of discrete arcuate segments comprising a first set of discrete arcuate segments that forms the first ring portion and a second set of discrete arcuate segments that forms the second ring portion, the first and second sets of arcuate segments being circumferentially offset, each arcuate segment of the first set comprises one of a guide pin and a slot and each arcuate segment of the second set comprises the other of the guide pin and the slot, the slot including an end stop, each guide pin extends into the elongate slot of a first offset segment such that movement of the first and second sets of arcuate segments toward the expanded position causes each guide pin to ride in its respective slot and contact the end stop to thereby arrest further movement of the segments toward the expanded position and control the size of each gap;

wherein the first ring portion is circumferentially offset from the second ring portion such that at least one of the first and second ring portions extends across the gaps during movement of the segments toward the expanded position to thereby prevent extrusion of the sealing sleeve through the gaps.

9. An anti-extrusion ring according to claim 8, wherein each arcuate segment of one of the first and second sets is securely connected to a second offset segment adjacent the first offset segment of the other of the first and second sets.

10. An anti-extrusion ring according to claim 9, wherein one of the first and second ring portions comprises an annular groove and the other of the first and second ring portions comprises an annular tongue that is received in the annular groove.

11. A downhole packer assembly for use in a well bore, the downhole packer assembly comprising:

an elongate mandrel adapted for positioning in the well bore;

an expander adapted for sliding movement along the mandrel;

a sealing sleeve disposed around the mandrel for engaging the well bore; and at least one anti-extrusion ring disposed between the expander and the sealing sleeve, the at least one anti-extrusion ring comprising:

first and second ring portions divided into a plurality of discrete arcuate segments for movement between a retracted position wherein each segment is in contact with adjacent segments, and an expanded position wherein gaps are formed between the segments, with one of the ring portions contacting the sealing sleeve, an elongate slot associated with each of the segments, the elongate slot having an end stop; and a guide pin extending from each of the segments and into the elongate slot of another segment, such that movement of the segments toward the expanded position causes each guide pin to ride in its respective slot and contact the end stop to thereby arrest further movement of the segments toward the expanded position and control the size of each gap, wherein the first ring portion is circumferentially offset from the second ring portion such that at least one of the first and second ring portions extends across the gaps during movement of the segments toward the expanded position to thereby prevent extrusion of the sealing sleeve through the gaps.

12. A downhole packer assembly according to claim 11, wherein the first and second ring portions are integrally formed together.

13. A downhole packer assembly according to claim 12, wherein each segment comprises:

an elongate slot associated with one of the first and second ring portions, the elongate slot having an end stop; and a guide pin extending from the other of the first and second ring portions and into the elongate slot of an adjacent segment, such that movement of the segments toward the expanded position causes each guide pin to ride in its respective slot and contact the end stop to thereby arrest further movement of the segments toward the expanded position and control the size of each gap.

14. A downhole packer assembly according to claim 11, wherein one of the first and second ring portions comprises an annular groove and the other of the first and second ring portions comprises an annular tongue that is received in the annular groove.

15. A downhole packer assembly according to claim 11, and further comprising at least one annular biasing member extending around the segments for holding the segments together.

16. A downhole packer assembly according to claim 11, wherein the first and second ring portions are constructed of a plastic material.

17. A downhole packer assembly according to claim 16, wherein the plastic material comprises polyether ether ketone.

18. A downhole packer assembly for use in a well bore, the downhole packer assembly comprising:

an elongate mandrel adapted for positioning in the well bore;

an expander adapted for sliding movement along the mandrel;

a sealing sleeve disposed around the mandrel for engaging the well bore; and at least one anti-extrusion ring disposed between the expander and the sealing sleeve, the at least one anti-extrusion ring comprising:

first and second ring portions divided into a plurality of discrete arcuate segments for movement between a retracted position wherein each segment is in contact with adjacent segments, and an expanded position wherein gaps are formed between the segments, with one of the ring portions contacting the sealing sleeve, the plurality of discrete arcuate segments comprises a first set of discrete arcuate segments that forms the first ring portion and a second set of discrete arcuate segments that forms the second ring portion, with the first and second sets of arcuate segments being circumferentially offset, each arcuate segment of the first set comprises one of a guide pin an a slot and each arcuate segment of the second set comprises the other of the guide pin and the slot, the slot including an end stop, and each guide pin extends into the elongate slot of a first offset segment, such that movement of the first and second sets of arcuate segments toward the expanded position causes each guide pin to ride in its respective slot and contact the end stop to thereby arrest further movement of the segments toward the expanded position and control the size of each gap, wherein the first ring portion is circumferentially offset from the second ring portion such that at least one of the first and second ring portions extends across the gaps during movement of the segments toward the expanded position to thereby prevent extrusion of the sealing sleeve through the gaps.

19. A downhole packer assembly according to claim 18, wherein each arcuate segment of one of the first and second sets is securely connected to a second offset segment adjacent the first offset segment of the other of the first and second sets.

20. A downhole packer assembly according to claim 19, wherein one of the first and second ring portions comprises an annular groove and the other of the first and second ring portions comprises an annular tongue that is received in the annular groove.

* * * * *